US007100904B2

(12) United States Patent
Kim

(10) Patent No.: US 7,100,904 B2
(45) Date of Patent: Sep. 5, 2006

(54) ADAPTABLE FENCE

(75) Inventor: Ki Hwan Kim, Chungcheongbuk-Do (KR)

(73) Assignee: New Green Chang Shin Co., Ltd., Eumseong-gun (KR)

( * ) Notice: Subject to any disclaimer, the term of this patent is extended or adjusted under 35 U.S.C. 154(b) by 7 days.

(21) Appl. No.: 10/225,277

(22) Filed: Aug. 22, 2002

(65) Prior Publication Data

US 2003/0193049 A1 Oct. 16, 2003

(30) Foreign Application Priority Data

Apr. 12, 2002 (KR) ..... 2002-20116

(51) Int. Cl.
*E04H 17/14* (2006.01)

(52) U.S. Cl. ..... 256/67; 256/59; 256/65.05; 256/22; 256/65.14; 256/DIG. 5

(58) Field of Classification Search ..... 256/59, 256/65.05, 65.04, 65.03, 65.14, 67, 19, 22, 256/65.06, DIG. 5
See application file for complete search history.

(56) References Cited

U.S. PATENT DOCUMENTS 3,910,561 A * 10/1975 Fornells ..... 256/65.08
3,915,434 A * 10/1975 Lister ..... 256/59
4,150,907 A * 4/1979 Thurnauer ..... 403/234
5,421,556 A * 6/1995 Dodge et al. ..... 256/1
5,480,126 A * 1/1996 Teasdale ..... 256/19
5,547,169 A * 8/1996 Russell ..... 256/67
5,660,376 A * 8/1997 West ..... 256/22
5,890,702 A * 4/1999 Lubore ..... 256/19
6,039,307 A * 3/2000 De Zen ..... 256/19
6,152,428 A * 11/2000 Simioni ..... 256/24
6,467,756 B1 * 10/2002 Elsasser ..... 256/65.14

FOREIGN PATENT DOCUMENTS

DE 3440160 A1 * 5/1986
EP 293337 A2 * 11/1988

* cited by examiner

*Primary Examiner*—James R. Brittain
(74) *Attorney, Agent, or Firm*—Birch, Stewart, Kolasch & Birch, LLP

(57) ABSTRACT

The present disclosure relates to a fence. More particularly, the disclosure relates to a fence capable of adapting to any angle of inclination comprising a plurality of columns, horizontal connecting members which have more than one degree of freedom through a connection between a pair of columns and vertical connecting members which are connected to the horizontal connecting members. The fence can be constructed easily on the ground irrespective of its angle of inclination and its linkage sections are completely protected from the outside exposure while having a sufficient structural strength.

12 Claims, 7 Drawing Sheets

ADAPTABLE FENCE

Applicant hereby incorporates by reference the subject matter of Republic of Korea Patent Application No. 2002-20116, filed in the Republic of Korea on Apr. 12, 2002. Applicant also claims benefit of Republic of Korea Patent Application No. 2002-20116 under 35 U.S.C.§.119.

BACKGROUND OF THE INVENTION

The present invention relates to a fence. More particularly, the invention relates to a fence capable of adapting to any angle of inclination comprising a plurality of columns, horizontal connecting members which have more than one degree of freedom through a connecting means between a pair of columns and vertical connecting members which are connected to the horizontal connecting members.

In general, the conventional fence comprises a plurality of columns which act as a structurally supporting member, horizontal connecting members and vertical connecting members which are connected to each other. The fence is usually made of metal or plastic and is constructed on the outside of a house or building in order to protect from intrusion as well as to define a perimeter.

However, the conventional fence can not easily be constructed on a ground with a degree of inclination due to its interconnected structure between horizontal connecting members and vertical connecting members. As a result, a separate fence that fits the inclination of the ground has to be manufactured.

Korean Utility No. 201594Y discloses an assembly fence which compensates the above mentioned weakness. As shown in FIGS. 1*a* and 1*b*, the disclosed fence comprises a circular column 11 which fixes the assembly fence firmly on the ground, a rail 21 which connects the column 11, a rail fixing bar 22 which joins the column 11 and rail 21, a pole 31 which is fixed on the rail at regular interval 31. A curvature section 24 exists at one side of the rail fixing bar 22 which is in contact with the column 11.

The above mentioned fence is constructed by first joining the rail fixing bar 22 with a curvature section 24 with the column 11, fixing the rail fixing bar 22 to the rail 21, joining another rail fixing bar 22 with the column 11 in order to maintain a fixed angle with respect to the rail which is fixed to the column 11, connecting another rail to the column 11, fixing the pole 31 which is formed by putting a front face plate and a back face plate together on the rail 21 at regular interval in order to construct a fence.

The angle of the above fence becomes fixed when the rail 21 and column 11 are joined together. As a result, it can not be constructed on an uneven surface with an angle of inclination and also it is prone to corrosion since the linkage sections are exposed to outside.

SUMMARY OF THE INVENTION

The object of the present invention is to provide a fence which can be constructed easily on the ground irrespective of its angle of inclination and its linkage sections are completely protected from the outside exposure while having a sufficient structural strength.

DESCRIPTION OF THE NUMERIC ON THE MAIN PARTS OF THE DRAWINGS

Figure 1A:
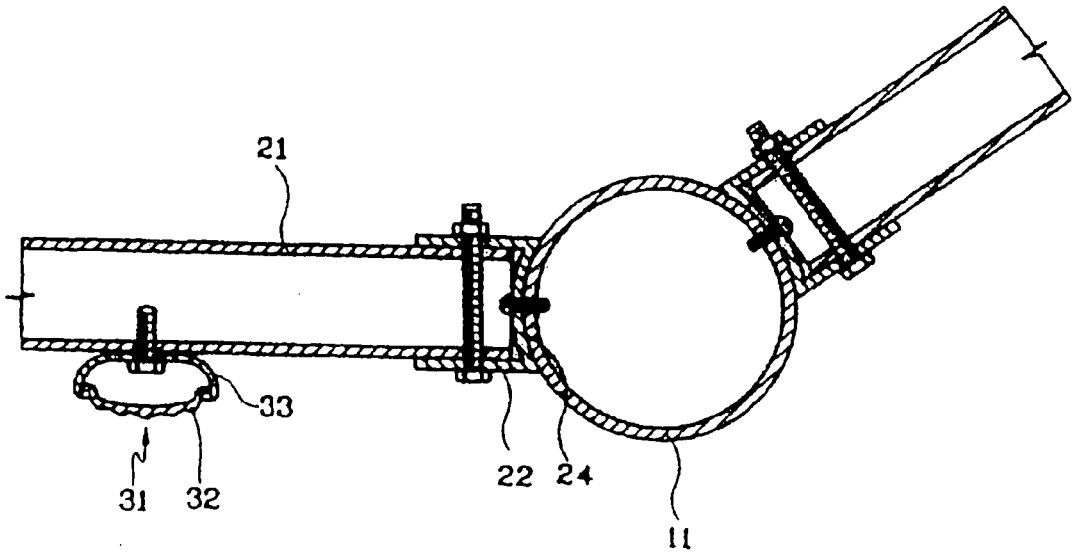
Fig.1A CONVENTIONAL ART
FIGS. 1*a* and 1*b* show a cross section view of the conventional fence and its installation.
Figure 1B:
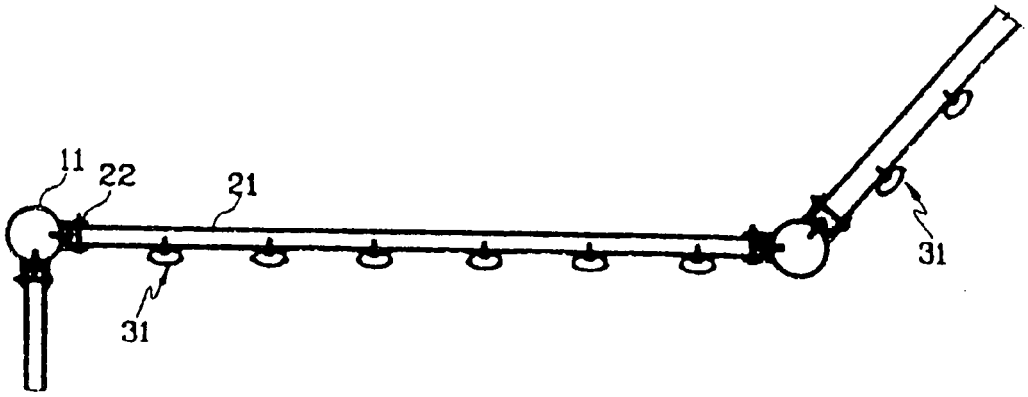
Fig.1B CONVENTIONAL ART
Figure 2:
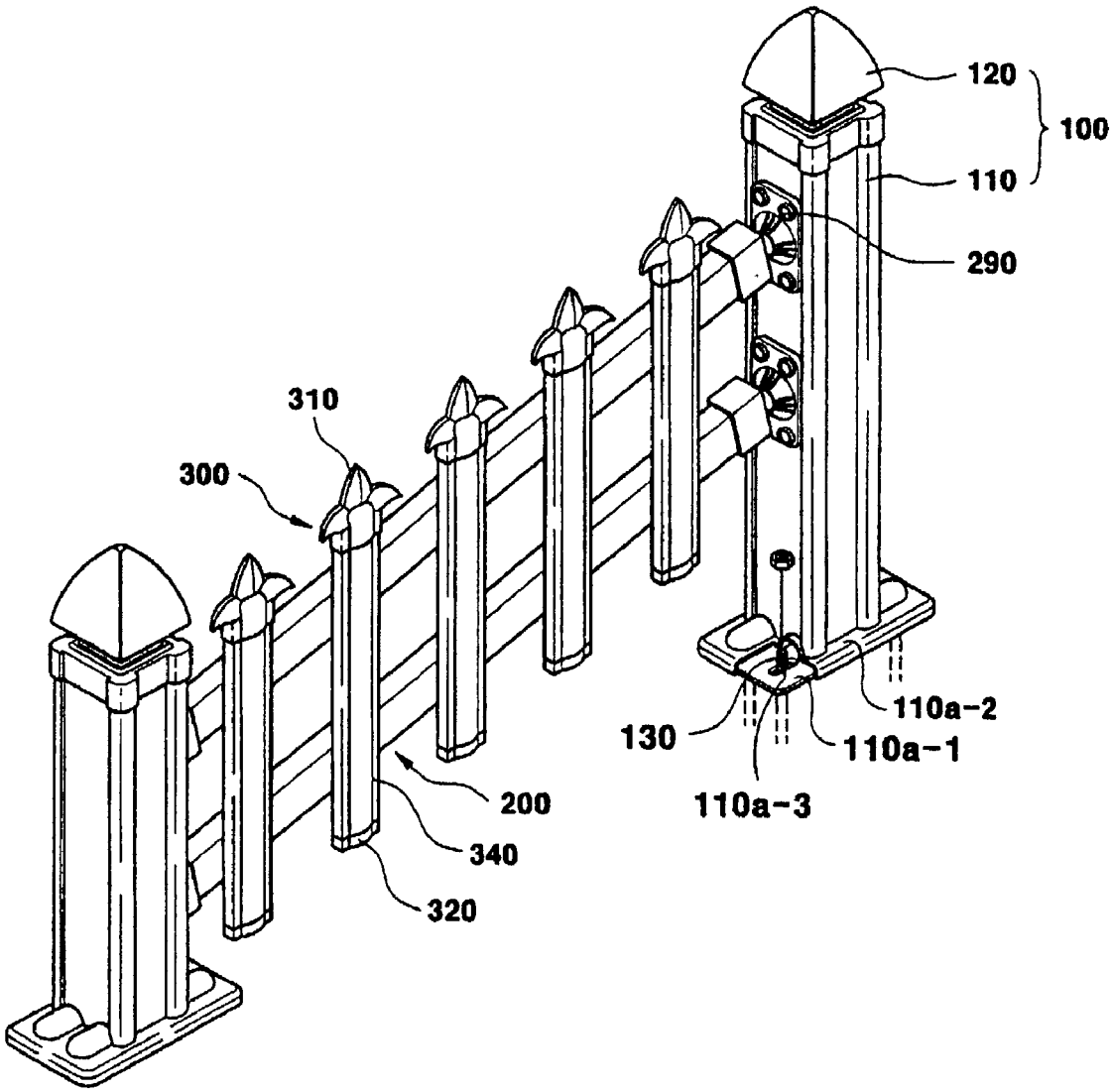
FIG. 2 is a perspective view of the fence according to the present invention.

100: Column
110: Main Body
120: Head
200: Horizontal Connecting Member
300: Vertical Connecting Member
330: Depressed Section
340: Decorating Plate

DETAILED DESCRIPTION OF THE EMBODIMENTS

The fence according to the present invention comprises: a plurality of columns each of which has a head and a supporting plate at the upper and lower end respectively; a plurality of horizontal connecting members each of which has more than one degree of freedom through a connecting means between a pair of said columns; a plurality of vertical connecting members each of which is perpendicularly connected to the horizontal connecting members at regular interval.

Hereinafter, preferred embodiments of the present invention will be described in detail with reference to the accompanying drawings.

As illustrated in FIGS. 2 through 7, the present invention comprises a column 100, a horizontal connecting member 200 which is connected to the column 100, a vertical connecting member 300 which is connected to the horizontal connecting member 200.

The column 100 comprises a main body 110, and a head which is fixed to the upper end of the main body.

The main body 110 comprises a main frame 110*a* which is made of metal having a supporting plate 110*a*-1 at the lower face, and a cover 110*b* which is made of plastic covering the whole exterior of the mainframe 110*a*.

On the internal surface of the cover 110*b*, a plurality of protruding ribs 110*b*-1 are formed as a single body and chambers 110*b*-2 exist at each of its four corner section in order to maintain certain amount of space between the corner sections and the mainframe 110*a*.

On the supporting plate 110*a*-1, a slit shape bolt hole is formed to be attached tightly while maintaining a clearance between the supporting plate and an anchor bolt 130, which is buried on the ground. A sealing member 110*a*-2 which covers the supporting plate 110*a*-1 is tightly attached on the outer surface of the cover 110*b*.

The lower face of a head 120 is constructed as identical to the shape of the cover 110*b* in order to be tightly attached to the upper end of the cover 110*b*. Also, the shape of the head is formed in such a way that no accumulation of rain could occur.

Also, the head 120 comprises a first head 120*a* and a second head 120*b* which are installed in such a way that they can either be separated or dismantled by a linking means 160.

The linking means 160 comprises a first attaching face 160*a* which is formed on the lower section of the first head 120*a*, a fixed protruding section 160*b* which protrudes at the center of the first attaching face 160*a*, a plurality of fixing pieces 160*c* which are constructed at the circumference of the fixed protruding section 160*b*, a second attaching face 160*d* which is formed on the upper section of the second head 120*b*, a supporting hole 160*e* which is formed at the center of said second attaching face 160*d*, a fixing groove 160*f* which is formed at the circumference of the supporting hole 160*e* corresponding to the fixing pieces 160*c*. At the one side of said fixing groove 160*f*, a lodging slot 160*g* which has a sliding face, is formed.

A horizontal connecting member 200 which is connected horizontally to the side of the column 100 through a connecting means 210 comprises a cover 220 and a frame 230 which is being inserted to inside of a cover 220. The cover 220 has ribs 220*a* on its internal face.

Furthermore, the connecting means 210 comprises a supporting body 210*a* which has a receiving space 210*a*-1 and a fixing plate 210*b* which allows omni-directional rotation through the second connecting means 210*d*.

The second connecting means 210*d* comprises a fixed ball 210*d*-2 which joins the supporting body with a fixing hole 210*d*-1 which is formed at one side of the fixing plate where the fixed ball 210*a*-2 can be lodged and rotated.

Figure 6A:
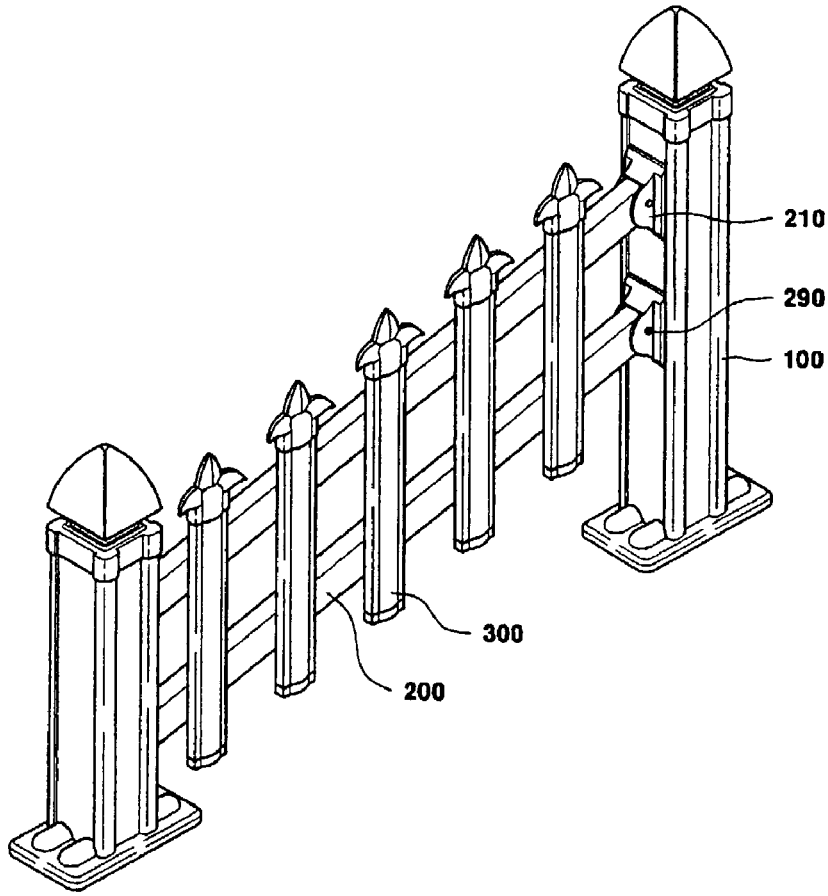
FIG. 6*a* is a perspective view of the fence according to another embodiment of the present invention.
Figure 6B:
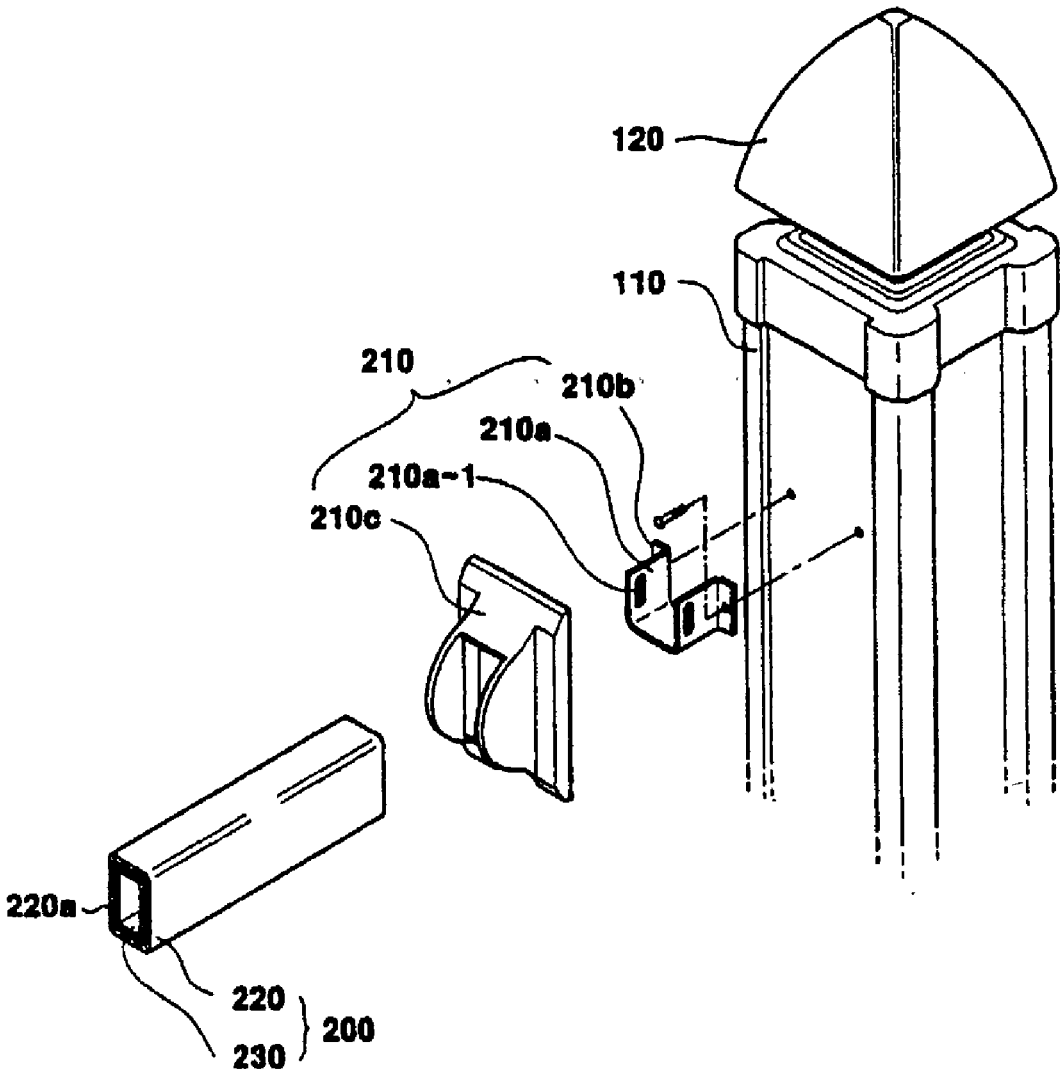
FIG. 6*b* an exploded view which shows the connection of a horizontal connecting member of the fence according to another embodiment of the present invention.

Alternatively, the connecting means 210 can comprise a supporting body 210*a* which is constructed to support the horizontal connecting member at three faces, and a fixing plate 210*b* which protrudes at one face of the connecting means 210 as a single body as shown in FIGS. 6*a* and 6*b*.

Also, a long hole 210*a*-1 is formed on the supporting body 210*a* and a covering member 210*c*, which has an open hole at the outside of the connecting means that allows a swing motion of the horizontal connecting member.

Figure 7:
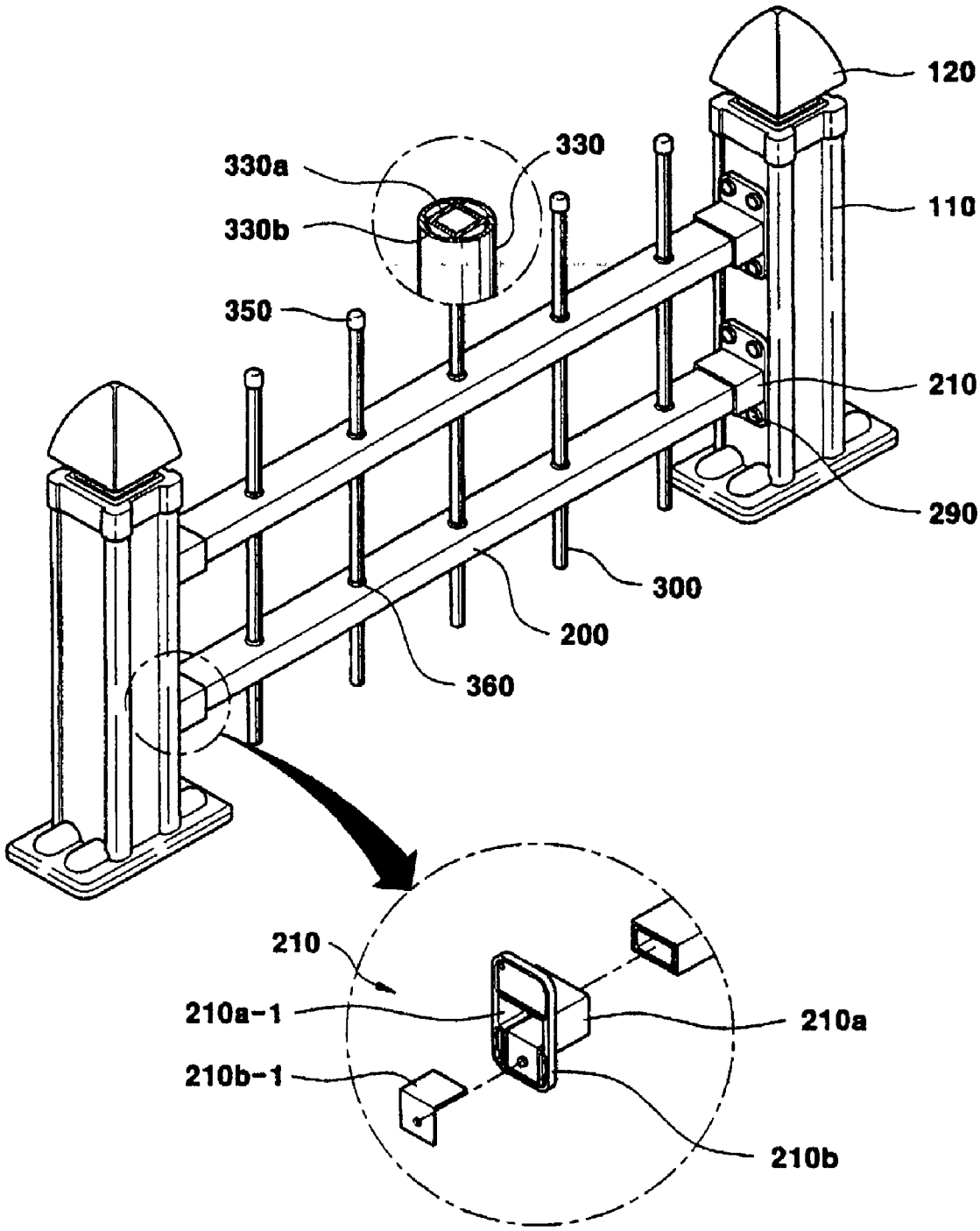
FIG. 7 is a perspective view of the fence according to yet another embodiment of the present invention.

The connecting means 210 comprises a supporting body 210*a* which has a receiving space 210*a*-1 and a fixing plate 210*b* that is connected to at one end of the connecting means 210 as a single body as shown in FIG. 7. The supporting piece 210*b*-1 which supports the horizontal connecting member 200 can be inserted to the inside of the fixing plate 210*b*.

The vertical connecting member 300 which is perpendicularly connected to the horizontal connecting member 200 along the longitudinal axis at regular interval.

A head 310 is fixed at the upper end of the vertical connecting member 300 and a sealing member 320 is fixed at the lower end of the vertical connecting member.

Figure 5A:
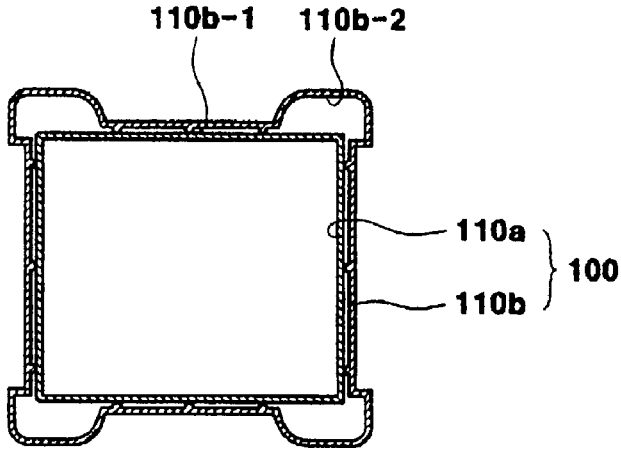
FIGS. 5*a*, 5*b* and 5*c* show a cross section and perspective view of the depressed section of the fence according to the present invention.
Figure 5B:
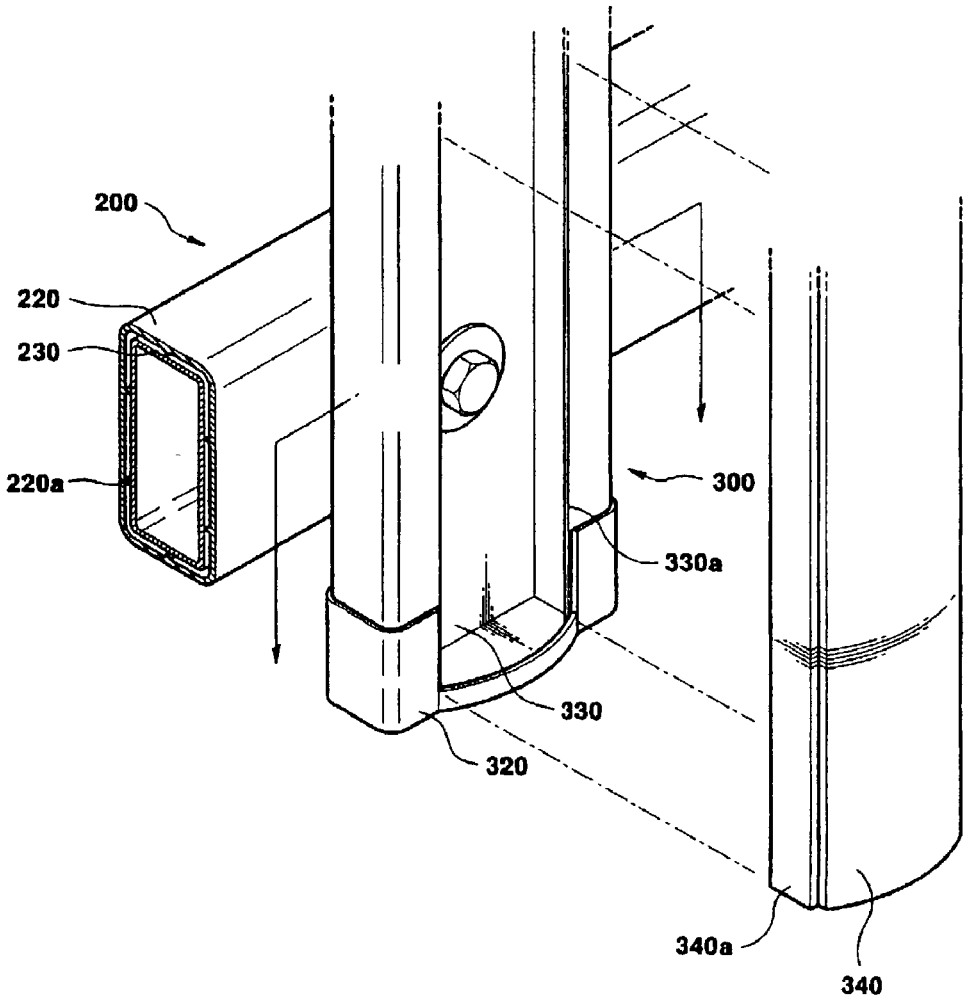
Figure 5C:
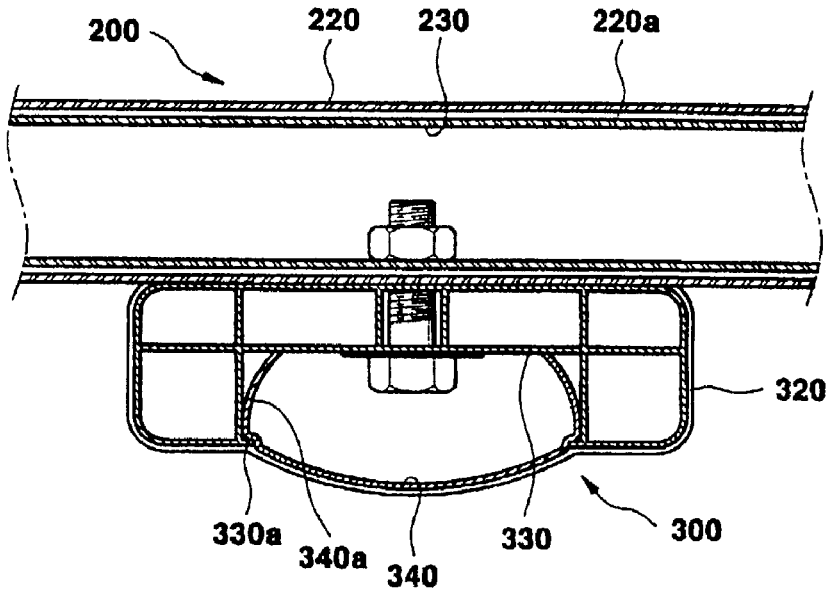

As shown in FIGS. 5*b* and 5*c*, a guide rail is formed at a depressed section 330 at one side of the vertical connecting member 300 and a decorating plate 340 is tightly attached to it. The decorating plate 340 has a tapered attach plate 340*a* at both sides whose width gradually decreases so as to be inserted easily to the guide rail 330*a*.

The sealing member 320 can either be tightly attached to the internal face or external face of the lower section of the vertical connecting member 300.

The vertical connecting member 300 comprises a plastic cover 330, and a metal frame 330*a* which is inserted to the inside of the plastic cover 330. The metal frame 330*a* has ribs 330*b* which prevent a trembling movement. At the upper and lower ends of the vertical connecting member 300, the sealing member 350 is tightly attached.

Also, the vertical connecting member 300 and horizontal connecting member 200 are joined together by inserting a T shape attaching member through the fixing hole that penetrates the vertical connecting member 300 and horizontal connecting member 200.

At one side of the column and connecting means, which are joined together by bolts or pieces, has some more bolts (pieces) connecting section 290*a* to be fixed by a sealing cap 290 at one side.

Hereinafter, the effects of the present invention with the above construction will be described in detail.

As shown in FIGS. 2 through 7, the column 100 and the horizontal connecting member 200 that interconnects between the two columns 100 are protected from corrosion due to contact with outside moisture by the plastic cover which covers the whole body of the metal frame. As a result, the life cycle of the fence is significantly extended.

The connecting means 210 that connects between the column 100 and the horizontal connecting member 200 is protected from a direct contact with moisture by forming a bolt connecting section 290*a* as a single body where a joint bolt can be inserted and a sealing cap is fixed when the joint bolt is installed on the bolt connecting section 290*a*.

The moisture intake to the column 100 and the horizontal connecting member 200 is prevented by tightly attaching the heads 120, 310, which are formed in such a way that no accumulation of rain could occur, to the upper section of the column 100 and the horizontal connecting member 200.

Furthermore, a loose movement of the column 100 is prevented when installed vertically by a supporting plate 110*a*-1 which is connected to a main frame 110*a* as a single body. When the supporting plate is connected to an anchor bolt which is buried under the ground, the column 100 is fixed on the upper face of the ground.

On the supporting plate 110*a*-1, a slit shape bolt hole is formed in order to attach tightly while maintaining a clearance between the supporting plate and an anchor bolt 130 which is buried under the ground, hence, improving the work efficiency.

At this instance, the sealing member 110*a*-2 which covers the supporting plate 110*a*-1 is tightly attached on the outer surface of the cover 110*b* in order to prevent any intake of moisture.

The cover 110*b* and the main frame 110*a*, which is inserted to the cover, are space apart by a plurality of ribs in order to maintain the internal space dry and to allow an easy control over setting the clearance when the cover is inserted to the outside of the frame as well as preventing any loose movement.

Since the heads 120 comprise a first head 120*a* and a second head 120*b* which are joined to by a linking means 160, the shape of the fence can be changed freely by installing various types of the first head 120*a* on the upper face of the second head 120*b*.

The user can vary the external appearance by changing the first head 120*a* which can have various shapes. A plurality of fixing pieces 160*c*, which are formed around the fixed protrusion 160*b*, are inserted to the fixing groove 160*f*, which is formed around the supporting hole 160*e* and directly facing the fixing pieces 160*c*, are firmly fixed by a rotating movement.

The fixing pieces 160*c* are firmly supported by a lodging slot 160*g* after being inserted along the sliding face at one side of the fixing groove 160*f*. As a result, the first and second heads are tightly attached together.

The horizontal connecting member 200 which is connected to the side of the column 100 in the horizontal direction is freely movable due to the connecting means 210, hence, the fence can be easily installed on a ground with various degrees of inclination.

As shown in FIG. 7, when the horizontal connecting member 200 is connected to a receiving space 210*a*-1, the connecting means 210 is fixed to a column 100 using a fixing plate 210*b* which is protruding as a single body from the side.

At this instance, the downwards movement of the connecting means are prevented by a "¬" shaped supporting piece which is inserted to the plastic fixing plate 210.

Also, the up and down movement of the horizontal connecting member 200 is possible by attaching it to a supporting body 210*a* through a hole 210*a*-1 as shown in FIG. 6. The covering member 210*c* is fixed outside of the supporting body 210*a* in order to protect corrosion of the supporting body.

Figure 3:
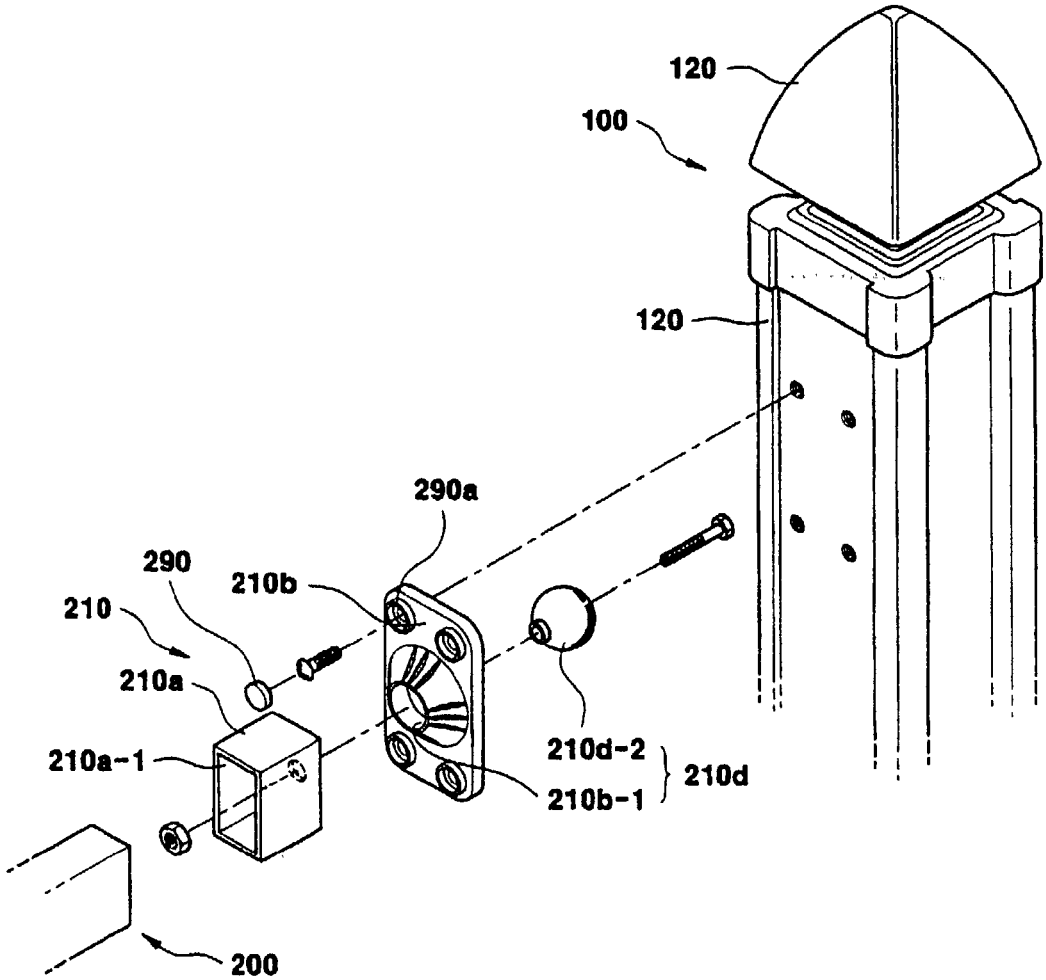
FIG. 3 is an exploded view which shows the connection of a horizontal connecting member of the fence according to the present invention.
Figure 4:
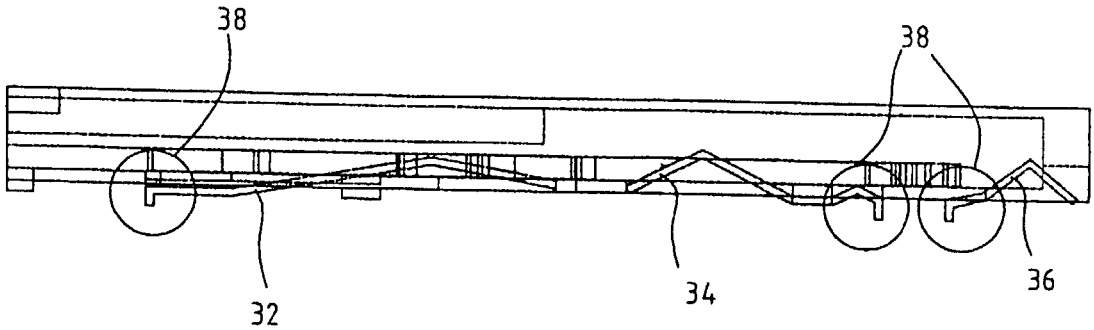
FIG. 4 is an exploded view which shows the head section of the fence according to the present invention.

The connecting means 210 can freely move in omni-direction around the column 100 by comprising a supporting body 210*a* which has a receiving spec as shown in FIG. 3 and a fixing plate 210*b* which can move freely through a second connecting means 210*d* at one side.

Also, the second connecting means 210*d* allows the free movement of the horizontal connecting member 200 by comprising a fixed ball 210*a*-2 which protrudes from the supporting body 210*a* and a fixing hole 210*b*-1 which is installed at one side of the fixing plate 210*b* and accepts the fixed ball 210*a*-2.

As shown in FIGS. 5*b* and 5*c*, a decorating plate 340 is fixed at the front side after forming a guide rail 330*a* at the depressed section 330 which is formed at one side of the vertical connecting member 300. At this instance, an attaching plate 340*a*, whose width becomes increasing narrower along the inside direction of the decorating plate 340, is easily inserted by pressing it.

Also, the decorating plate with various colors can be inserted in order to be able to change the external appearance of the fence. The decorating plate prevents exposures of bolts in order to protect them from corrosion.

When an external shock is applied to the decorating plate 340, the shock is absorbed by the attaching plate 340*a* which protrudes from outside of the vertical connecting member 300 when it is installed on the guide rail 330*a*.

The shape of the head 310 is such that the water on the upper section can freely flow downwards. The shape of the lower section is such that at one end of the vertical connecting member 300 can easily be inserted to it.

The vertical connecting member 300 comprises a frame 330*a* which is inserted between the cover 330 and inside of the vertical connecting member 300. It is fixed to a horizontal connecting member by a T shaped attaching member 360. Ribs are installed on the cover in order to prevent the trembling movement of the frame 330*a*.

The fence according to the present invention can be constructed easily on the ground irrespective of its angle of inclination and its linkage sections are completely protected from the outside exposure while having a sufficient structural strength.

Also, the shock which traveling to the fence can be absorbed therefore preventing the shock reaching the column.

The following is a detailed explanation through examples of the invention. It should be understood, however, that the detailed description and specific examples are given by way of illustration only, since various changes and modifications within the spirit and scope of the invention will become apparent to those skilled in the art from this detailed description.

What is claimed is:

1. A fence assembly, comprising:

a plurality of columns each of which has an upper and lower end and sides and a replaceable head attachable at the upper end;

horizontal connecting members each of which has a number of faces connectable horizontally to the side of said plurality of columns through a connecting means which comprises a cover having an inside surface and an outside surface and an upper surface and a frame adapted to be inserted inside of the cover;

a plurality of ribs located on an inside surface of the cover; and vertical connecting members each of which has an upwardly opening upper and lower opening lower ends and sides and is adapted to be perpendicularly connected to said horizontal connecting members at regular intervals along the horizontal connecting members;

and further comprising a head and a sealing member which are adapted to be fixed respectively at the upwardly opening upper and lower opening lower ends of the vertical connecting members.

2. A fence assembly, comprising:

a plurality of columns each of which has an upper and lower end and sides and a replaceable head attachable at the upper end;

horizontal connecting members each of which has a number of faces connectable horizontally to the side of said plurality of columns through a connecting means which comprises a cover having an inside surface and an outside surface and an upper surface and a frame adapted to be inserted inside of the cover;

a plurality of ribs located on an internal inside surface of the cover; and vertical connecting members each of which is has upper and lower ends and sides and is adapted to be perpendicularly connected to said horizontal connecting members at regular intervals along the horizontal connecting members;

and further comprising a head and a sealing member which are adapted to be fixed respectively at the upper and lower ends of the vertical connecting members, and wherein each of the plurality of columns has a main body comprising a main-frame which is made of metal; a supporting plate at its lower end; and a cover which is made of plastic and covers the whole exterior of said mainframe; and wherein the column cover has four corner sections and comprises a plurality of protruding ribs which are formed as a single body and chambers which are located at each of its four corner sections for maintaining a certain amount of space between the corner sections and mainframe.

3. The fence assembly as claimed in claim 2, wherein:

the supporting plate comprises a slit shaped bolt hole to tightly attach and maintain a clearance between said supporting plate and an anchor bolt adapted to be buried under the ground; and a sealing member which covers the supporting plate and is tightly attached to the outer surface of the column cover.

4. The fence assembly as claimed in claim 1, wherein:

the lower end of said replaceable head has a face which is identical to the shape of a column cover attachable to the upper end of the column in order to be tightly attached to the upper end of the column cover and the shape of the head is formed in such a way to prevent the accumulation of rain and the head further comprising a first head having upper and lower sections and a second head having upper and lower sections which heads are adapted to either be separated or dismantled by a linking means.

5. The fence assembly as claimed in claim 4, wherein the linking means comprises:

a first attaching face on the lower section of the first head;

a fixed protruding section at the center of the first attaching face;

a plurality of fixing pieces on the circumference of the fixed protruding section;

a second attaching face on the upper section of the second head;

a supporting hole located at the center of the second attaching face;

a fixing groove having sides located on the circumference of the supporting hole and corresponding to the fixing pieces; and a lodging slot which has a sliding face at one side of the fixing groove.

6. The fence assembly as claimed in claim 1, wherein the connecting means comprises a supporting body which has a receiving space, a fixing plate having sides and a frame which support the horizontal connecting members and is insertable to one side of fixing plate.

7. The fence assembly as claimed in claim 1, wherein: the connecting means comprises a supporting body to support the horizontal connecting members at three of its faces; and a fixing plate which protrudes at one surface of the connecting means as a single body; and a long hole located on the supporting body; and a covering member which has an open hole at an outside surface of the connecting means that allows a swing motion of the horizontal connecting members.

8. The fence assembly as claimed in claim 1, wherein the connecting means comprises a supporting body which has a receiving space and a fixing plate which allows omni-directional rotation through the connecting means.

9. The fence assembly as claimed in claim 8, wherein the connecting means comprises a fixed ball which joins the supporting body with a fixing hole that is formed on one side of the fixing plate where the fixed ball can be lodged and rotated.

10. The fence assembly as claimed in claim 1, wherein one side of the vertical connecting members has a depressed section and the vertical connecting members comprise a guide rail which is formed at the depressed section and a decorating plate having sides with a guide protrusion at both sides which is elastically constructed.

11. The fence assembly as claimed in claim 1, wherein the vertical connecting members each comprise a frame which is insertable to the inside of a cover and is fixable to horizontal connecting members by a T shaped attaching member and ribs on the inside of said vertical connecting member cover to prevent a trembling movement of the vertical connecting member frame.

12. The fence assembly as claimed in claim 1, further comprising a bolt connecting section at one side of the connecting means where the bolt is linked and a sealing cap which is attached to one side of the connecting means.

* * * * *